US007234890B1

(12) United States Patent
Marshall et al.

(10) Patent No.: US 7,234,890 B1
(45) Date of Patent: Jun. 26, 2007

(54) JOINT FOR BULLET TRAPS

(75) Inventors: Thomas Marshall, Provo, UT (US); Lane Jackson, Provo, UT (US); Addison Sovine, Provo, UT (US); Kyle Bateman, Provo, UT (US)

(73) Assignee: Action Target, Inc., Provo, UT (US)

( * ) Notice: Subject to any disclaimer, the term of this patent is extended or adjusted under 35 U.S.C. 154(b) by 164 days.

(21) Appl. No.: 09/942,112

(22) Filed: Aug. 28, 2001

Related U.S. Application Data

(60) Provisional application No. 60/228,371, filed on Aug. 28, 2000.

(51) Int. Cl.
*F41J 1/12* (2006.01)

(52) U.S. Cl. ..... 403/408.1; 89/36.01; 89/36.02; 89/36.04; 273/410

(58) Field of Classification Search ..... 403/408.1, 403/256, 286, 292, 293; 256/24, 25; 52/276, 52/281; 89/36.01, 36.02, 36.04; 273/410; 220/560.01
See application file for complete search history.

(56) References Cited

U.S. PATENT DOCUMENTS

| | | | | |
|---|---|---|---|---|
| 774,959 | A | 11/1904 | Tresidder | |
| 867,406 | A * | 10/1907 | Pates | 403/286 |
| 908,255 | A | 1/1911 | Herms et al. | |
| 980,255 | A * | 1/1911 | Herms et al. | |
| 1,035,908 | A | 8/1912 | Richardson | |
| 1,155,717 | A | 10/1915 | Fouts | |
| 1,199,357 | A | 9/1916 | Evans, Jr. | |
| 1,724,601 | A * | 8/1929 | Kellogg | 428/99 |
| 1,803,514 | A | 5/1931 | Thomas | |
| 1,957,933 | A | 5/1934 | Brandl | |
| 2,054,665 | A | 9/1936 | Tracy | |
| 2,105,784 | A | 1/1938 | Hagberg | |
| 2,170,637 | A | 8/1939 | Hatch et al. | |
| 2,208,010 | A | 7/1940 | Whitmore | |
| 2,209,580 | A | 7/1940 | Sargent | |
| 2,212,982 | A | 8/1940 | Drain, Jr. et al. | |
| 2,231,528 | A | 2/1941 | Daniels | |
| 2,269,490 | A | 1/1942 | Slick | |
| 2,350,827 | A | 6/1944 | Saulnier | |
| 2,412,242 | A | 12/1946 | Beaud | |
| 2,628,388 | A | 2/1953 | Poth | |
| 2,927,665 | A | 3/1960 | Hauf | |
| 2,932,860 | A | 4/1960 | Barth | |
| 3,423,891 | A | 1/1969 | Burris | |
| 3,485,405 | A | 12/1969 | Dement | |
| 3,530,633 | A | 9/1970 | Scott | |
| 3,969,855 | A | 7/1976 | Lendi | |

(Continued)

FOREIGN PATENT DOCUMENTS

| | | |
|---|---|---|
| AU | 127432 | 4/1948 |

(Continued)

*Primary Examiner*—Daniel P. Stodola
*Assistant Examiner*—Michael P. Ferguson

(57) ABSTRACT

An improved joint utilizes a facing strip which is configured to extend away from a pair of plates held by the facing strip as one moves toward the middle of the facing strip. When the steel plates are disposed at an angle to one another, the facing strip is preferably straight. When the steel plates are parallel, the facing strip is preferably bent to extend toward the plates as one moves out from the middle of the facing strip and toward the lateral edges.

11 Claims, 11 Drawing Sheets

U.S. PATENT DOCUMENTS

| | | | | | |
|---|---|---|---|---|---|
| 4,028,856 | A | | 6/1977 | Dlabec | |
| 4,254,600 | A | | 3/1981 | Zwissler | |
| 4,677,798 | A | | 7/1987 | Phillips | |
| 4,856,791 | A | | 8/1989 | McQuade | |
| 5,400,692 | A | | 3/1995 | Bateman | |
| 5,600,084 | A | * | 2/1997 | Gonzalez | 89/36.02 |
| 5,670,734 | A | * | 9/1997 | Middione et al. | 89/36.04 |
| 5,822,936 | A | * | 10/1998 | Bateman | 52/281 |

FOREIGN PATENT DOCUMENTS

| | | | |
|---|---|---|---|
| AU | 202340 | | 7/1956 |
| CH | 597 451 | | 4/1978 |
| DE | 227342 | | 10/1910 |
| DE | 498308 | | 5/1930 |
| DE | 514123 | | 11/1930 |
| DE | 877489 | | 4/1953 |
| DE | 2021 170 | | 11/1971 |
| DE | 3635741 | A | 7/1992 |
| FR | 2461-069 | | 1/1910 |
| FR | 832754 | | 10/1938 |
| FR | 849829 | | 12/1939 |
| FR | 1.156.211 | | 5/1958 |
| GB | 50-207 | | 5/1903 |
| GB | 280832 | | 11/1927 |
| GB | 725189 | | 3/1955 |
| NL | 7700295 | | 1/1977 |

* cited by examiner

JOINT FOR BULLET TRAPS

RELATED APPLICATIONS

The present application claims priority to U.S. Provisional Patent Application No. 60/228,371, filed Aug. 28, 2000.

BACKGROUND OF THE INVENTION

1. Field of the Invention

The present invention relates to joint strips which are used on bullet traps. More particularly, the present invention relates to such joint strips which reduce the risk of splatter through between two walls of a bullet trap and which lessen the cost of manufacturing the joint strips.

2. State of the Art

In order to maintain proficiency in the use of firearms, it is common for law enforcement officers and sportsmen to engage in target practice. In conventional target practice, a target, i.e. an outline of a person or animal is held before a bullet trap. The bullet receives bullets fired at the target and contains the bullet so that it may be retrieved and recycled.

Any steel bullet trap, however, requires a joint where two ends of a section meet. This joint has traditionally been made in the manner shown in FIGS. 1 and 2. A bullet trap wall 8 or 8' is formed by a flat strip of steel 10 is used for the front side facing the shooter. The strip 10 typically either has bolts 12 welded to the back side, or countersunk holes 14 for bolts to drop through. A washer 16 or leg (not shown) is used on the back side in conjunction with a nut 20 to secure a bolt 22. As the nut 20 is tightened on the bolt 22, the plate 10 and washer 16 or leg 18 pinch two adjoining pieces of steel plate 26 together. During this process, the plate 10 and the washer 16 or leg 18 are disposed generally parallel with the steel plates 26.

Such configurations have several problems. First, the vibration which accompanies a round hitting a steel plate eventually causes the weld to fail, thereby allowed the welded bolts break off. While bolts placed in countersunk holes generally do not break off, it is difficult to manufacture joints with countersunk holes.

Yet another problem with both of these configurations, is that the front strip can eventually curve away from the pieces of steel plate and increase the risk that a bullet will pass through the space between the steel plates 26. The resulting splatter through can be dangerous to those in the area. Additionally, it may allow lead bullets outside of the range where they may leach lead into the environment.

Thus, there is a need for a new method of forming joint strips. Such a configuration should be less susceptible to breaking of bolts and less expensive/difficult than countersinking bolts.

SUMMARY OF THE INVENTION

Thus, it is an object of the present invention to provide an improved bullet joint strip and method for making the same.

The above and other object of the invention are achieved by a bullet joint strip which can be more readily attached without breaking and which can decrease the risk of splatter through. In accordance with one aspect of the invention, at least one, and typically a plurality of brackets are attached to the back of a facing strip. This is typically accomplished by welding the brackets to the facing strip.

The brackets are configured to receive an end of the bolt so that the bolt can be tightened to bring the facing strip into secure engagement with adjacent steel plates forming the joint. Because a much larger area of the bracket can be welded to the facing strip than is typically done with the head of a bolt, the risk that the weld will brake is significantly reduced.

In accordance with another aspect of the present invention, the facing strip is beveled to that it has two outwardly and rearwardly sloping walls. As the bolt of the joint strip is tightened, the pitched nature of the facing strip causes the ends of the facing strip to come into contact with the adjacent plates forming the joints. Because the ends of the facing strip first engage the plates, the risk that the ends will curl and pull away from the plates is significantly reduced. To the contrary, the ends of the facing strip tend to be in a compression state against the plates, further reducing the risk of splatter through.

In accordance with still yet another aspect of the present invention, the a flat facing plate is used in conjunction with an angle joint plate to minimize bullet impacts on the angle joint plate and thereby reduce the risk of splatter through.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 3:
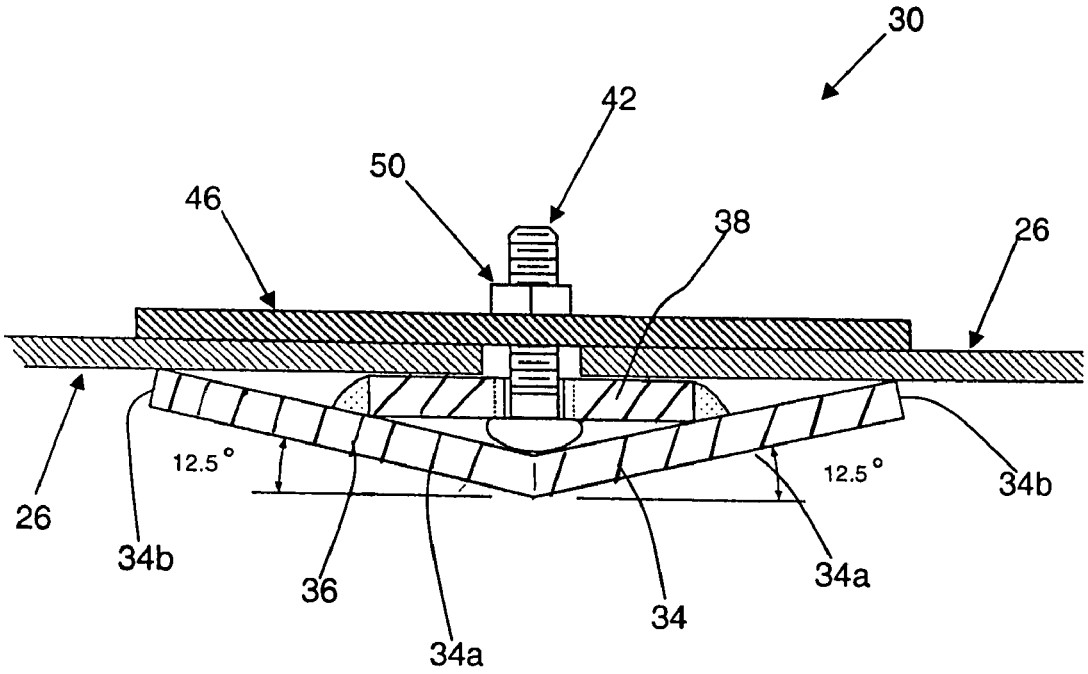
FIG. 3 shows a cross-sectional view of a bullet trap joint made in accordance with the teachings of the present invention.

Referring to FIG. 3, there is shown a cross-sectional view of a joint, generally indicated at 30, made in accordance with the principles of the present invention. As mentioned above, the joints of the prior art suffer from several problems. One significant problem is that welded bolt heads as used in the prior art have a tendency to brake. The bolt heads provide relatively little area to form a weld and are subject to vibration caused by bullets hitting the bullet trap.

Another problem with the prior art is that forming countersunk holes in plate steel or other bullet resistant materials is expensive and time consuming. Yet another problem with both alternate configurations of the prior art is that the lateral edges of the facing strip have a tendency to curl up, weakening support for the associated plates and increasing the risk of splatter through.

These problems are resolved by the joint 30 which is shown in FIG. 3. The joint 30 has a bent facing strip 34 which extends away from the wall toward the middle of the strip. In other words, the joint strip has two outwardly and rearwardly sloping walls 34*a* from a central longitudinal axis. Preferably, the bend provides and angle of about 12.5 degrees.

The bend in the facing strip 34 prevents the strip from curving away from the steel plates 26 and keeps the lateral edges 34*b* of the facing strip engaging the plates. Because of the tight engagement, the facing plate 34 is less likely to let small bullet fragments pass through opening between the plates 26.

The joint strip 36 formed by the facing plate 34 also has a bracket 38 welded to the back side. The bracket 38 is configured with an opening 38*a* (FIG. 5) so that a bolt 42 slides into this bracket. The bolt 42 also engages a backing plate or a washer 46 to secure the facing strip to the plates 26. This makes it simple to replace a broken bolt without replacing the entire strip 34.

The bracket 38 preferably has more than two inches of weld coverage attaching it to the facing strip 34. This is contrast to the small amount of weld coverage provided by the head of a bolt and prevents the bracket 38 from breaking away from the strip 34 due to the vibrations caused when a round of ammunition impacts the joint 30.

The washer 46 on the back side of the plates 26 is preferably over-sized to give greater pinching force on the plates 26 when the nut 50 is tightened. While a backing plate can be used if desired, the secure engagement created by the beveled facing plate 34 is sufficiently strong that a backing plate is generally not necessary. Backing plates may be desirable, however, if high powered rounds are being used.

Figure 4:
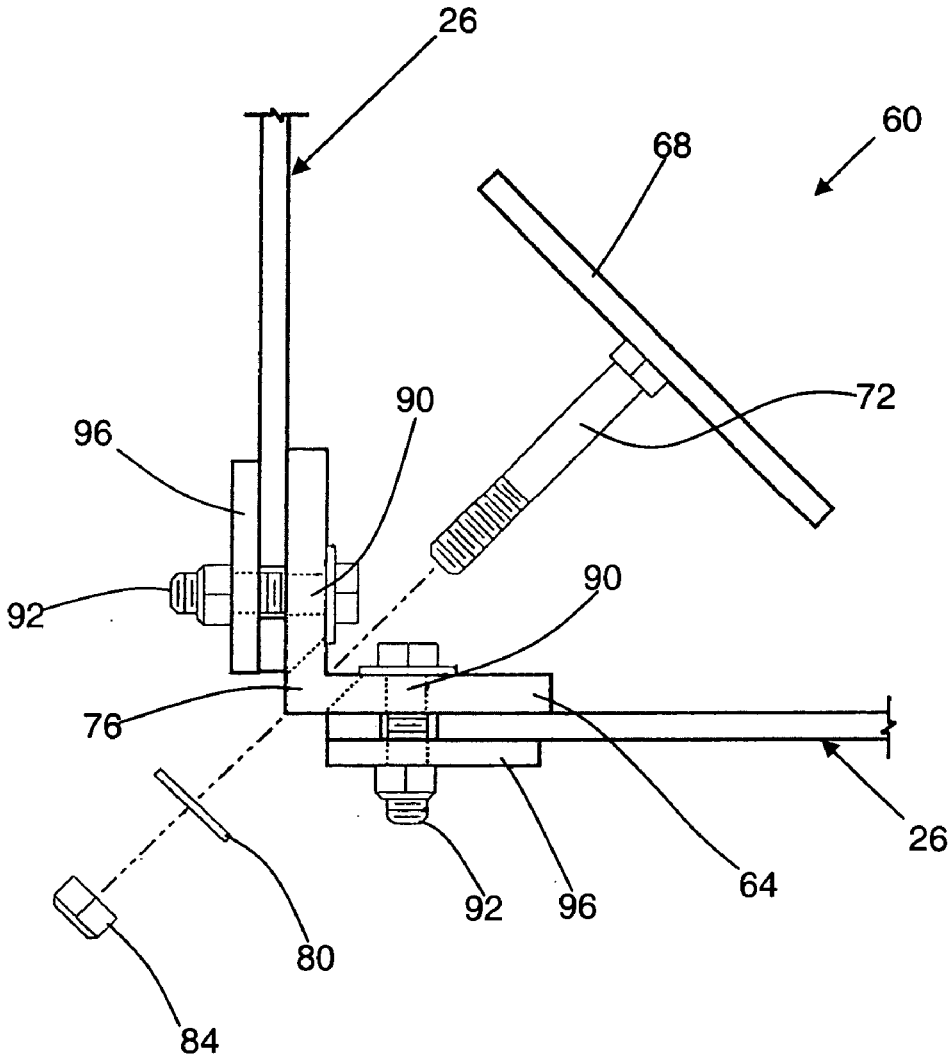
FIG. 4 shows a top view of a joint for holding plates in a perpendicular arrangement in accordance with the present invention.

FIG. 4 shows a method for forming a joint 60 with similar advantages when the plates 26 are disposed perpendicular to one another. Typically, an angle joint 64 is used to hold the two pieces of steel plate 26 together. The angle joint 64 has openings 90 through which bolts 92 extend. Tightening the bolts pinches the ends of the plates between the angle joint 64 and a washer or backing strip 96.

Figure 1:
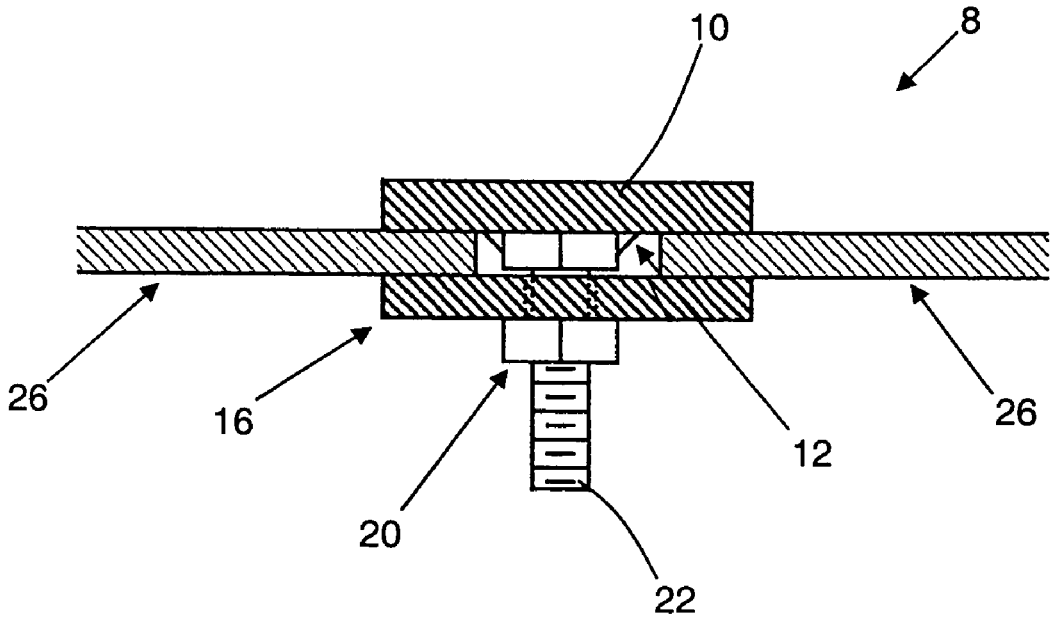
FIG. 1 (Prior Art)
FIG. 1 shows a cross-sectional view of a bullet trap joint made in accordance with the teachings of the prior art wherein the head of a bolt is welded to a facing strip.
Figure 2:
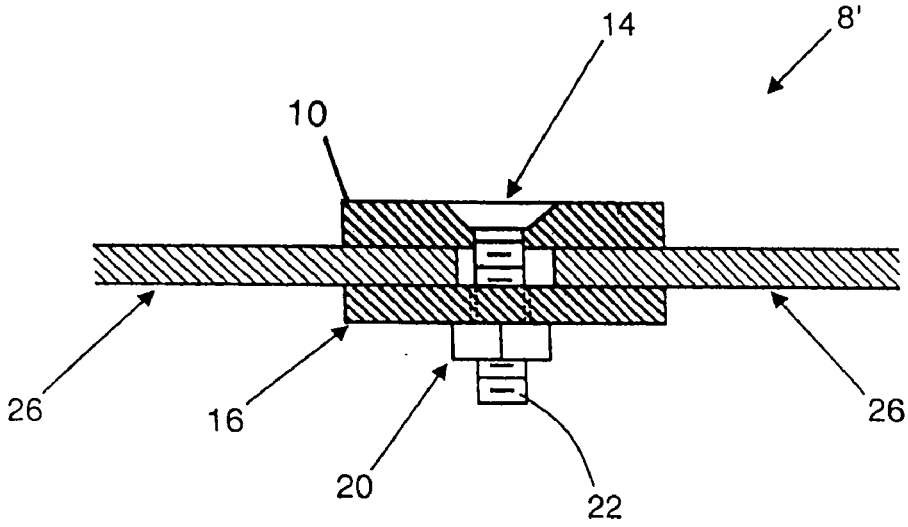
FIG. 2 (Prior Art)
FIG. 2 a cross-sectional view of an alternate embodiment of a prior art bullet trap joint, wherein the bolt is positioned in a countersunk hole.

Unfortunately, the angle joint 64 can suffer the same problems as the flat joint discussed in FIGS. 1 and 2. These problems are resolved by providing a facing strip 68 which forms a flat plate. A bolt 72 is attached to the flat plate either by welding or by a bracket such as that discussed with respect to FIG. 3.

A channel 76 is formed in the angle joint 64 to allow the bolt 72 to pass therethrough and engage a washer 80 and nut 84. As the nut 84 is tightened, the bolt draws the facing strip 68 into contact with the plates 26 at an angle of about 45 degrees. The facing strip 26 covers the angle joint 64 and prevents splatter through the opening between the plates 26.

Figure 5:
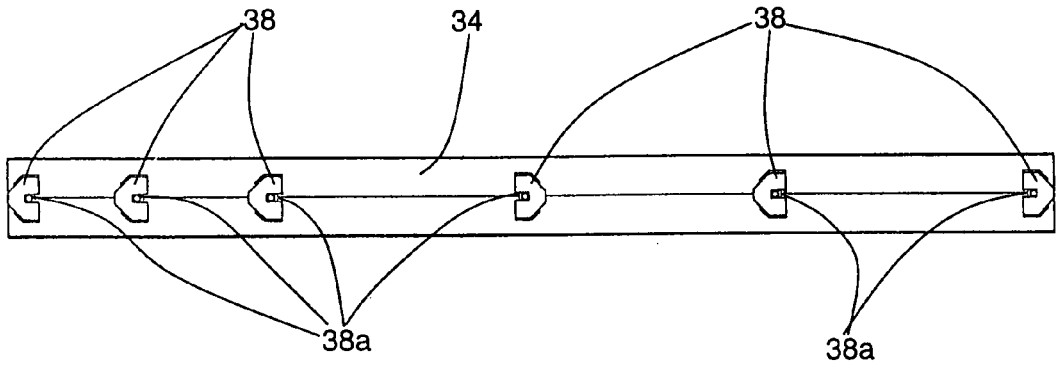
FIG. 5 shows a rear view of the joint strip shown in FIG. 3.

FIG. 5 shows a back view of the facing strip 34 and a plurality of brackets 38. Preferably, some of the brackets 38 are rotated 180 degrees from each other so that the openings 38*a* are on opposite sides of the brackets. This prevents the facing strip 34 from moving relative to the bolts 42 so that the bolts are pulled out of the brackets 38. Thus, the only way to remove the facing strip 34 once it is in place is to undo the nuts behind the washer 46 or backing plate.

Figure 6:
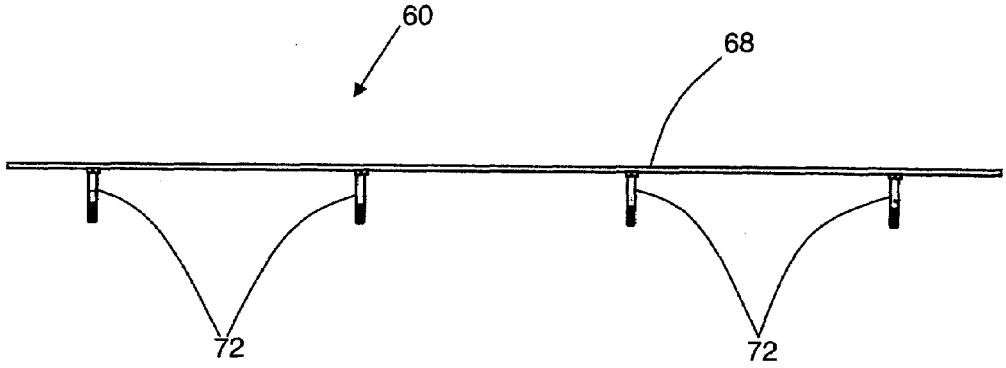
FIG. 6 shows a side view of the facing plate shown in FIG. 4.

Turning now to FIG. 6, there is shown a side view of the facing plate or strip 68 discussed with respect to FIG. 4. The facing strip 68 is attached to a plurality of bolts 72. This can be accomplished by welding the bolts 72 to the facing strip 68 or by providing a plurality of brackets, such as those shown on the facing strip 34 in FIG. 5. For the reasons discussed above, the brackets are preferred. However, because the facing 3 strip 68 is not holding the plates 26 together, the welds on the bolts will generally last longer than those on a facing plate such as that shown in FIG. 1.

Figure 6A:
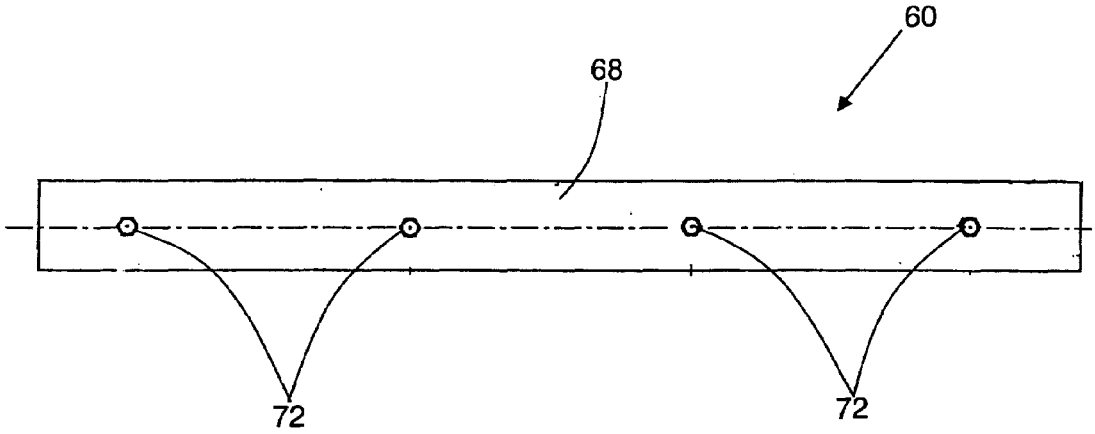
FIG. 6A shows a rear view of the facing plate shown in FIGS. 4 and 6.
Figure 6B:
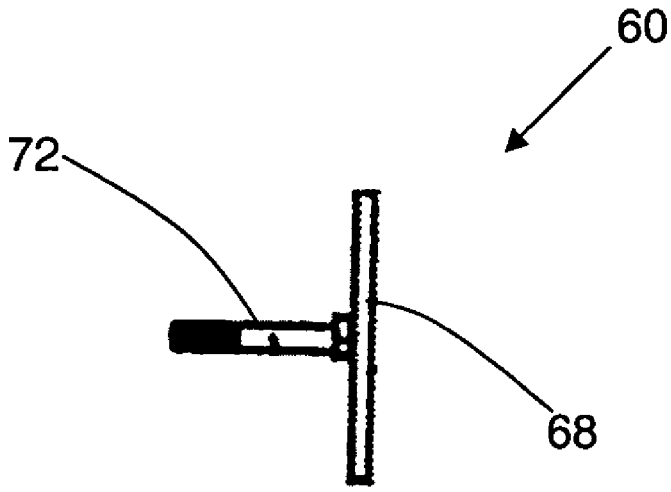
FIG. 6B shows and end view of the facing plate shown in FIGS. 6 and 6A.

FIG. 6A shows a back view and FIG. 6B shows an end view of the facing strip 68 discussed with respect to FIGS. 4 and 6. It is important to note that the spacing of the bolts 72 is not critical to the functioning of the facing plate 68. However, the bolts 72 need to align with the openings 76 in the angle joint 64 (FIG. 4) to facilitate mounting of the facing plate 68.

Figure 7:
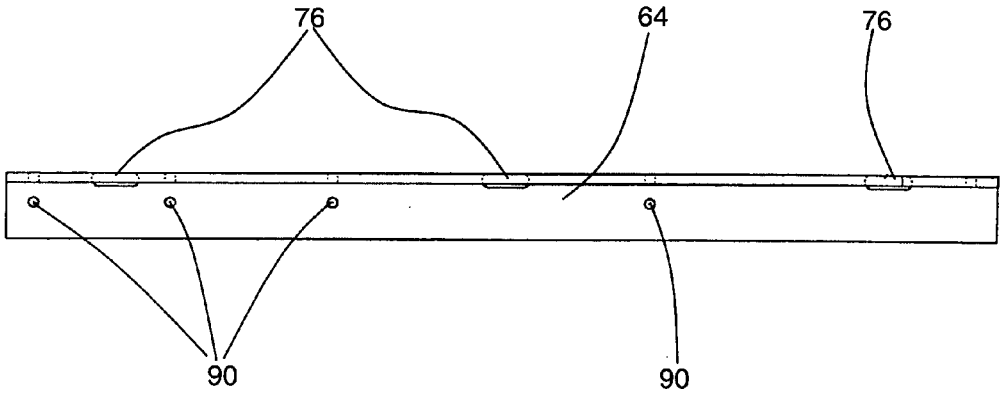
FIG. 7 shows a side view of the angle joint shown in FIG. 4.
Figure 7A:
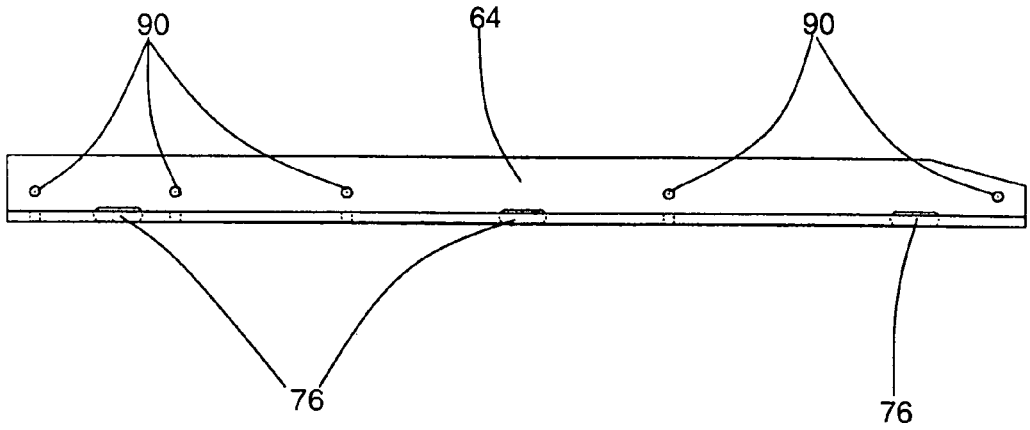
FIG. 7A shows another side view of the angle joint of FIG. 4.
Figure 7B:
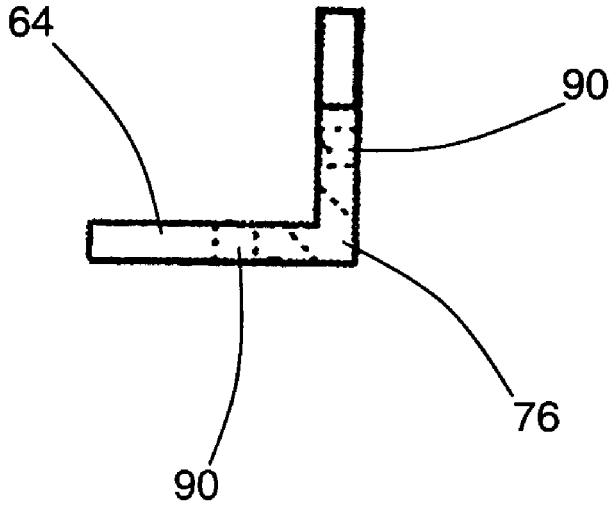
FIG. 7B shows and end view of the angle joints of FIGS. 4, 7 and 7A.

Turning now to FIGS. 7 through 7B, there are shown two side views and an end view of angle joints 64 which have been modified to provide channels 76 for the bolts (not shown) of the facing plate (not shown). The angle joints 64 also have openings 90 formed therein which are used to secure bolts 92 (FIG. 4) which hold the angle joints 64 to the plates 26. The angle joints 64 are typically about 2.5 inches on each side, so that they provide adequate support without wasting material.

Thus there is disclosed an improved Joint for Bullet Traps. Those skilled in the art will appreciate numerous modifications which can be made without departing from the scope and spirit of the present invention. The appended claims are intended to cover such modifications.

What is claimed is:

1. A joint for bullet traps, the joint comprising:

a first plate;

a second plate disposed in a linear arrangement with the first plate so as to form a joint;

a facing strip disposed along the joint, the facing strip having a first end and a second end with lateral edges extending along the sides therebetween configured for engaging the first plate and the second plate, the facing strip being bent between the lateral edges of the facing strip so as to form two sides which slope outwardly from the bend to the lateral edges and toward the first plate and the second plate such that the facing strip contacts the first plate and the second plate only at the lateral edges of the facing strip;

at least one bracket, the at least one bracket comprising a slot at an edge of the at least one bracket and extending inwardly therefrom, the at least one bracket being welded to the facing strip;

a backing means placed along the joint on the side of the first and second plates opposite the facing strip; and at least one bolt for attaching the facing strip to the backing means, the at least one bolt being disposed in the slot of the at least one bracket so at to be attached to the facing strip without penetrating through the facing strip.

2. The joint for bullet traps of claim 1, wherein the at least one bracket is generally flat and disposed generally parallel to the lateral edges of the facing strip.

3. The joint for bullet traps of claim 2, wherein the first plate and second plate comprise bullet proof plate steel.

4. The joint for bullet traps of claim 2, wherein the at least one bracket comprises at least two brackets each having a slot formed therein for receiving a bolt, and wherein the slots on the at least two brackets are disposed on opposite sides of the brackets from one another.

5. The joint for bullet traps of claim 1, wherein the facing strip has sides extending rearwardly to the first plate and the second plate at an angle of about 12.5 degrees.

6. The joint for bullet traps of claim 2, wherein the at least one bracket contacts the first and second plates.

7. A joint of a bullet trap, the joint comprising:

a first bullet proof metal plate;

a second bullet proof metal plate having an edge disposed adjacent an edge of the first bullet proof metal plate;

a facing strip being bent along the center thereof so as to define two sides and so as to form an angle less than 180 degrees between the two sides such that the two sides extend both outwardly and backwardly from the center thereof, and having lateral edges extending substantially the length of the facing strip, the facing strip being disposed along the adjacent edges of the first and second plates so as to cover the adjacent edges of the first and second plates such that only the lateral edges of the facing strip contact the first and second plates;

at least one bracket comprising a flat piece of plate steel having a slot formed therein, the slot at an edge thereof and extending inwardly therefrom, the at least one bracket being disposed in a generally planar relationship to the lateral edges of the facing strip and being welded to the facing strip, the at least one bracket being configured for engaging a bolt so as to hold the bolt to the facing strip without the bolt penetrating through the facing strip; and at least one bolt for holding the facing strip against the first and second plates.

8. The joint according to claim 7, wherein the sides of the facing strip extend rearwardly from the bent central portion at an angle of about 12.5 degrees.

9. The joint according to claim 7, wherein the at least one bracket comprises a plurality of brackets, each of the brackets having a slot extending from an edge thereof for receiving a bolt and at least two of the brackets having the slot on opposing sides thereof.

10. A bullet proof joint comprising:

a pair of bullet proof steel plates disposed such that an edge of one plate is adjacent the edge of the other plate;

a joint strip disposed to cover the adjacent edges of the bullet proof plates comprising:

a facing strip defining a pair of sloped walls extending outwardly and rearwardly from a central portion extending along a long axis of the facing strip such that only the edges of the sloped walls contact the plates, wherein the facing strip is bent lengthwise into an angle of about 155 degrees, and wherein sides of the facing strip extend linearly so as to contact the bullet proof steel plates only at an edge thereof; and means for attaching a plurality of bolts to the facing strip without the bolts penetrating through the facing strip comprising a plurality of brackets permanently attached to the facing strip, each of the brackets being configured to receive a bolt;

a backing strip disposed to cover the adjacent edges of the bullet proof plates on the side of the plates opposite the facing strip; and a plurality of bolts for holding the facing strip, bullet proof plates, and backing strip together.

11. The joint according to claim 10, wherein at least two of the brackets have slots for receiving a bolt, the slots being disposed on opposing sides of the brackets.

* * * * *

UNITED STATES PATENT AND TRADEMARK OFFICE

CERTIFICATE OF CORRECTION

PATENT NO. : 7,234,890 B1
APPLICATION NO. : 09/942112
DATED : June 26, 2007
INVENTOR(S) : Thomas Marshall et al.

It is certified that error appears in the above-identified patent and that said Letters Patent is hereby corrected as shown below:

Column 1:
Line 21, it reads "The bullet receives bullets fired..."; should read --The bullet trap receives bullets fired...--
Line 26, it reads "...formed by a flat strip of steel 10 is used for the..."; should read --...formed using a flat strip of steel 10 on the...--
Line 28, it reads "12 welded to the back..."; should read --22 welded (indicated at 12) to the back...--
Line 32, it reads "...or leg 18 pinch two..."; should read --...or leg pinch two...--
Line 34, it reads "...or leg 18 are disposed..."; should read --...or leg are disposed...--
Lines 39 and 40, it reads "...thereby allowed the welded bolts break off."; should read --...thereby allowing the welded bolts to break off.--
Line 59, it reads "The above and other object..."; should read --The above and other objects...--

Column 2:
Line 17, it reads "invention, the a flat facing..."; should read --invention, a flat facing...--
Line 45, it reads "FIG. 6B shows and end view..."; should read --FIG. 6B shows an end view...--
Line 51, it reads "FIG. 7B shows and end view..."; should read --FIG. 7B shows an end view...--

Column 3:
Line 17, it reads "...the bend provides and angle..."; should read --...the bend provides an angle...--
Line 23, it reads "...pass through opening between..."; should read --...pass through an opening between...--
Line 33, it reads "...facing strip 34. This is"; should read --...facing strip 34. This is in--

UNITED STATES PATENT AND TRADEMARK OFFICE

CERTIFICATE OF CORRECTION

PATENT NO. : 7,234,890 B1
APPLICATION NO. : 09/942112
DATED : June 26, 2007
INVENTOR(S) : Thomas Marshall et al.

It is certified that error appears in the above-identified patent and that said Letters Patent is hereby corrected as shown below:

Column 4:

Line 1, it reads "...relative to the bolts 42 so that"; should read --...relative to the bolts 42 (FIG. 3) so that--

Line 4, it reads "...the washer 46 or backing plate."; should read --...the washer 46 (FIG. 3) or backing plate.--

Line 12, it reads "...because the facing 3 strip 68..."; should read --...because the facing strip 68...--

Signed and Sealed this

Tenth Day of February, 2009

John Doll

JOHN DOLL
*Acting Director of the United States Patent and Trademark Office*